US005086699A

United States Patent [19]

Philpot

[11] Patent Number: 5,086,699

[45] Date of Patent: Feb. 11, 1992

[54] COMBINATION ROLL COVERING AND SPECIALLY CONFIGURED PRINTING PLATE SECUREMENT APPARATUS

[75] Inventor: Ivan N. Philpot, Irving, Tex.

[73] Assignee: Matthews International Inc., Pittsburgh, Pa.

[21] Appl. No.: 675,744

[22] Filed: Mar. 27, 1991

[51] Int. Cl.[5] ..... B41F 27/00

[52] U.S. Cl. ..... 101/415.1; 101/378; 101/383

[58] Field of Search ..... 101/376, 378, 382.1, 101/383-389, 415.1, 485, 486, DIG. 36

[56] References Cited

U.S. PATENT DOCUMENTS

| | | | |
|---|---|---|---|
| 3,213,790 | 10/1965 | McKay | 101/376 |
| 3,228,329 | 1/1966 | Mangus et al. | 101/378 |
| 3,295,443 | 1/1967 | Devon | 101/376 |
| 3,489,085 | 1/1970 | Kirkpatrick | 101/415.1 |
| 3,675,573 | 7/1972 | Hawks | 101/378 |
| 3,745,921 | 7/1973 | MacDonald et al. | 101/378 |
| 3,934,509 | 1/1976 | Saunders et al. | 101/415.1 |
| 4,932,324 | 6/1990 | Pinkston et al. | 101/415.1 |

OTHER PUBLICATIONS

Rogers Corporation News Release.

"It's Time for a Change in Flexo", Box Board Containers, Dec. 1979.

*Primary Examiner*—Edgar S. Burr

*Assistant Examiner*—Ren Yan

*Attorney, Agent, or Firm*—Armstrong, Nikaido, Marmelstein, Kubovcik & Murray

[57] ABSTRACT

This invention provides a flexible sheet-like roll covering and securement apparatus for a printing plate. The apparatus includes a first flat strip-like portion, a second flat strip-like portion narrower than the first strip-like portion and a third strip-like portion which is also narrower than the first strip-like portion. A first connecting strip-like portion connects one outer edge of the first strip-like portion to an outer edge of the second strip-like portion and a second connecting strip-like portion connects an axially opposed outer edge of the first strip-like portion to an outer edge of the third strip-like portion thereby forming an S-shaped securement apparatus having a flexible sheet-like roll covering member secured to such first flat strip-like portion.

20 Claims, 1 Drawing Sheet

COMBINATION ROLL COVERING AND SPECIALLY CONFIGURED PRINTING PLATE SECUREMENT APPARATUS

FIELD OF THE INVENTION

The present invention relates, in general, to equipment used in printing arrangements for securing a printing plate, having predetermined printing indicia disposed on an outer surface thereof, to at least a predetermined portion of a working surface of at least one printing plate cylinder disposed in at least one print station of such printing arrangement and, more particularly, this invention relates to a combination flexible roll covering and specially configured printing plate securement apparatus which enables both securing one end of a carrier sheet having such printing plate disposed on an upper surface thereof to such predetermined portion of such working surface of such at least one printing plate cylinder and an achievement of a relatively quick alignment of such printing plate in a predetermined position on such working surface of such printing plate cylinder.

CROSS-REFERENCE TO RELATED APPLICATIONS

The invention taught and claimed in this application is closely related to U.S. patent application Ser. No. 07/586,272 entitled, "An Apparatus for Securing a Printing Plate to a Printing Plate Cylinder and a Printing Plate Composite Utilizing Such Apparatus", filed on Sept. 21, 1990 and to U.S. patent application Ser. No. 07/586,273 entitled, "An Improved Printing Plate Composite Including a Quick Mounting System for Securing Such Composite to a Printing Plate Cylinder", filed on Sept. 21, 1990 and to U.S. Ser. No. 07/662,727 entitled, "A Printing Plate Mounting System and a Printing Plate Composite Utilizing Such System", filed on Feb. 28, 1991 and is related to U.S. patent application Ser. No. 07/675743 filed concurrently herewith and to U.S. patent application Ser. No. 07/675751 also filed concurrently herewith. The disclosure of such closely related U.S. patent applications being incorporated herein by reference thereto.

BACKGROUND OF THE INVENTION

During the recent past, it has become the generally accepted practice, in the retail sales industry, to utilize what is known in the packaging manufacturing industry as "point of sales" packaging for the majority of products to be offered for sale in a retail outlet. This particular practice, as generally would be expected, has forced the package manufacturing industry to both develop and implement new equipment and operating procedures. Such new equipment and operating procedures being necessary so that significant improvement in the quality of printing could be economically achieved. In other words, the former "brown box" would no longer be an acceptable package for products offered for sale in a retail outlet.

As a result, flexographic printing was introduced into such package printing industry and such flexographic printing equipment is now in widespread use. See, for example, an article published in the December, 1979 issue of Box Board Containers titled "It's Time for a Change in Flexo". As pointed out in this particular article, flexographic printing equipment entered the package printing industry in the 1960's. It was at this time that packaging converters began installing the necessary equipment to initiate use of the flexographic printing process. It is important to note that such packaging converters had the capability of now printing, slotting, folding, gluing, die-cutting and bundling in a true production line manner with this new flexographic equipment.

This change in printing equipment to flexography also offered the potential for extended capabilities and other improvements in package printing. This, in addition, to all the advantages of the in-line operations discussed above. This was not the case, however, because these additional benefits were not immediately taken advantage of by the packaging converters. For example, even with this new flexographic printing equipment and process, the packaging converters continued to use the same old style printing plate systems that they had been using prior to the introduction of the flexo printing system. This outdated printing plate system consisted of a relatively thick rubber plate secured to a fabric-like material which, in turn, was secured to a carrier material.

It is also generally well known, in the prior art, to use a substantially T-shaped member in order to both align and secure one end of a printing plate, carried on a sheet material, to the printing plate cylinder. Such securement of the printing plate occurring substantially parallel to the longitudinal axis of the printing plate cylinder. In this case, the printing plate is disposed on a vinyl-like sheet member which, in turn, is positioned for engagement with the working surface of such printing plate cylinder. The T-shaped member is secured to one end of the vinyl-like sheet and the axially opposed other end of such vinyl-like sheet is secured to the printing plate cylinder with either tape or strap-like members.

This particular fastening system for the printing plate is commonly known in the package printing industry as the Matthews Fast-Loc. This system, which is in widespread use in the packaging industry, results in a significant reduction in down time of the printing press being required in order to achieve proper alignment of the printing plate on the working surface of the printing plate cylinder. In this manner, economy of operation could be achieved by the packaging convertors.

SUMMARY OF THE INVENTION

The present invention provides a combination flexible roll covering and specially configured printing plate securement apparatus. This securement apparatus is used to secure one end of a carrier sheet having at least one printing plate disposed on an upper surface of such carrier sheet to at least a predetermined portion of a working surface of at least one printing plate cylinder. Such printing plate cylinder being disposed in at least one print station of a printing arrangement. Such securement arrangement is also used to achieve a relatively quick alignment of such printing plate in a predetermined position on such working surface of the printing plate cylinder. This combination flexible roll covering and specially configured printing plate securement apparatus includes a first elongate and substantially flat strip-like portion having each of axially opposed outer edges and axially opposed surfaces. Such first flat strip-like portion further has a first predetermined length, a first predetermined width and a first predetermined thickness. Further, there is a generally flexible and substantially rectangular-shaped sheet-like roll covering member incorporated into the apparatus. This sheet-like roll covering member having axially opposed surfaces and a pair of axially opposed outer edges. Such sheet-like roll covering member also has a predetermined length and a predetermined width and a predetermined thickness. A relatively narrow portion of an upper surface of such sheet-like roll covering member being engaged with at least a portion of a first surface of such axially opposed surfaces of such first flat strip-like portion adjacent a first outer edge of a first pair of such pair of axially opposed outer edges. This first outer edge of such first pair of such pair of axially opposed outer edges is located along such predetermined width of the sheet-like roll covering member; and, such at least a portion of such first surface of such axially opposed surfaces of the first flat strip-like portion being located along such first predetermined length of such first flat strip-like portion. In addition, such securement apparatus includes a securing means engageable with such first flat strip-like portion and the sheet-like roll covering member which secures such sheet-like roll covering member to the first flat strip-like portion. The securement apparatus also includes a second elongated an substantially flat strip-like portion having each of axially opposed outer edges and axially opposed surfaces. Such second flat strip-like portion further having a second predetermined length, a second predetermined width, which is less than such first predetermined width of the first flat strip-like portion, and a second predetermined thickness. A first surface of such axially opposed surfaces of such second flat strip-like portion is positioned facing a first surface of such axially opposed surfaces of the first flat strip-like portion. Further, such securement apparatus includes a third elongated and substantially flat strip-like portion having each of axially opposed outer edges and axially opposed surfaces. Such third flat strip-like portion further having a third predetermined length and a third predetermined width, which is also less than such first predetermined width of such first flat strip-like portion, and a third predetermined thickness. A first surface of such axially opposed surfaces of the third flat strip-like portion is positioned such that it faces a second surface of such axially opposed surfaces of the first flat strip-like portion. In addition, the apparatus includes a first elongated connecting strip-like portion having axially opposed outer edges and axially opposed surfaces. This first connecting strip-like portion further having a fourth predetermined length and a fourth predetermined width and a fourth predetermined thickness. A first outer edge of such axially opposed surfaces of such first connecting strip-like portion is connected to a first outer edge of such axially opposed outer edges of such first strip-like portion substantially along the first predetermined length of such first strip-like portion and such fourth predetermined length of such first connecting strip-like portion. A second outer edge of such axially opposed outer edges of such first connecting strip-like portion is connected along such fourth predetermined length thereof to a first outer edge of the axially opposed outer edges of the second elongated flat strip-like portion along the second predetermined length thereof. A second outer edge of such axially opposed outer edges of the second flat strip-like portion being engageable in a groove-like portion formed adjacent a working surface of such printing plate cylinder. This groove-like portion being disposed substantially parallel to a longitudinal axis of the printing plate cylinder. The final essential element of the securement apparatus is a second elongated connecting strip-like portion which has axially opposed outer edges and axially opposed surfaces. This second connecting strip-like portion further has a fifth predetermined length and a fifth predetermined width, which is equal to or less than the such fourth predetermined width of the first connecting strip-like portion, and a fifth predetermined thickness. A first outer edge of such axially opposed outer edges of the second connecting strip-like portion is connected to a second outer edge of such axially opposed outer edges of such first flat strip-like portion along such first predetermined length of such first flat strip-like portion and the fifth predetermined length of such second connecting strip-like portion. A second outer edge of such axially opposed outer edges of such second connecting strip-like portion being connected along the fifth predetermined length thereof to a first outer edge of such third flat strip-like portion along the third predetermined length thereof, thereby forming a specially configured S-shaped printing plate securement apparatus having a roll covering member incorporated therewith.

OBJECTS OF THE INVENTION

It is, therefore, one of the primary objects of the present invention to provide a combination roll covering and specially configured printing plate securement apparatus which enables at least one printing plate carried on a carrier sheet to be relatively quickly aligned in a predetermined position on a working surface of a printing plate cylinder.

Another object of the present invention is to provide a combination roll covering and specially configured printing plate securement apparatus which enables rapid securement of one end of a printing plate carrier sheet to at least a portion of such roll covering disposed on a working surface of a printing plate cylinder.

Still another object of the present invention is to provide a specially configured printing plate securement apparatus which can be formed as an integral single piece unit thereafter and have a flexible sheet-like roll covering member secured thereto.

Yet another object of the present invention is to provide a combination roll covering and specially configured printing plate securement apparatus which is relatively inexpensive to manufacture.

A further object of the present invention is to provide a combination roll covering and specially configured printing plate securement apparatus which is relatively simple to use.

An additional object of the present invention is to provide a combination roll covering and specially configured printing plate securement apparatus which reduces the down time of a printing arrangement when it becomes necessary to change printing plates thereby improving the productivity of such printing arrangement.

Still yet another object of the present invention is to provide a combination roll covering and specially configured printing plate securement apparatus which will assist in improving the quality of multi-color printing jobs.

Yet still another object of the present invention is to provide a combination roll covering and specially configured printing plate securement apparatus which will enable a significant reduction in rejected product thereby minimizing substrate requirements.

A still further object of the present invention is to provide a combination roll covering and specially configured printing plate securement apparatus which will exhibit a relatively long useful life.

It is another object of the present invention to provide a combination roll covering and specially configured printing plate securement apparatus which can be readily adapted to different printing arrangements.

Still an additional object of the present invention is to provide a combination roll covering and specially configured printing plate securement apparatus which will provide enhanced quality of print material on a substrate material.

Another object of the present invention is to provide a combination roll covering and specially configured printing plate securement apparatus which will tolerate slight imperfections in a working surface of a printing plate cylinder.

Yet still another object of the present invention is to provide a combination roll covering and specially configured roll covering and printing plate securement apparatus which will reduce board crush during a printing operation.

Even though a number of rather specific objects and advantages of the combination roll covering and specially configured printing plate securement apparatus have been set out in detail above, various other objects and advantages of the present invention will become more readily apparent to those persons who are skilled in the printing plate securement art from the following, more detailed description of such invention, particularly, when such description is taken in conjunction with the attached drawing figures and with the appended claims.

BRIEF DESCRIPTION OF THE VARIOUS EMBODIMENTS OF THE PRESENT INVENTION

Figure 1:
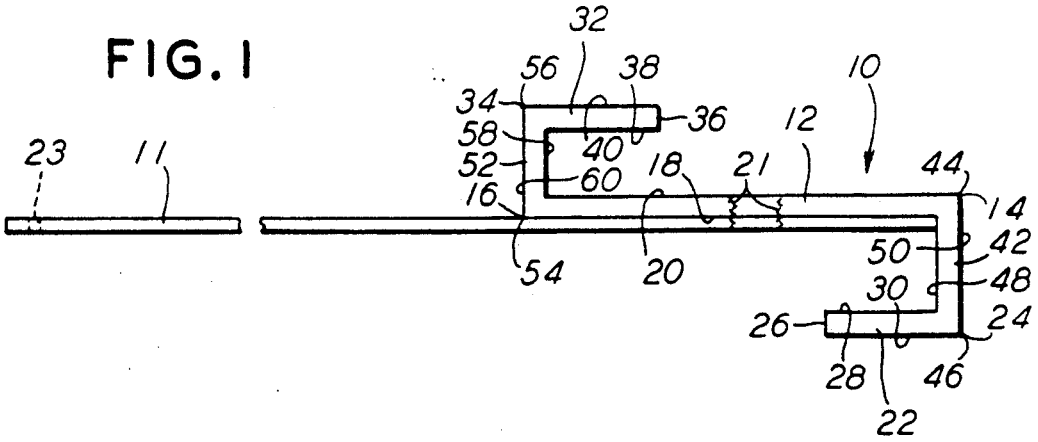
FIG. 1 is a side elevation view of a presently preferred embodiment of the combination roll covering and specially configured printing plate securement apparatus constructed according to the present invention.

Prior to proceeding to the more detailed description of the combination roll covering and specially configured printing plate securement apparatus, it should be noted that, in each of the drawing figures, identical components having identical functions have been identified, for the sake of clarity, with identical reference numerals.

Now refer, more particularly, to FIG. 1. Illustrated therein is a combination roll covering and specially configured printing plate securement apparatus, generally designated 10, for use both in securing one end of a carrier sheet (not shown) having at least one printing plate (not shown) disposed on an upper surface thereof to at least a predetermined portion of a working surface (not shown) of at least one printing plate cylinder (not shown) disposed in at least one print station (not shown) of a printing arrangement (not shown) and in achieving a quick alignment of such printing plate in a predetermined position on the working surface of such printing plate cylinder. Such printing plate having predetermined indicia disposed on an upper surface thereof.

This combination roll covering and specially configured printing plate securement apparatus 10 comprises a first elongated and substantially flat strip-like portion 12 having each of axially opposed outer edges 14 and 16 and axially opposed surfaces 18 and 20. Such first flat strip-like portion 12 further having a first predetermined length and a first predetermined width and a first predetermined thickness.

Apparatus 10 further includes a generally flexible and substantially rectangular-shaped sheet-like roll covering member 11 having axially opposed surfaces 13 and 15 and a pair of axially opposed outer edges 17 and 19. Such sheet-like roll covering member further has a predetermined length and a predetermined width and a predetermined thickness. A narrow portion of an upper surface 13 of this sheet-like roll covering member 11 is engaged with at least a substantial portion of a first surface 18 of such axially opposed surfaces 18 and 20 of the first flat strip-like portion 12 adjacent a first outer edge of a first 17 of the pair of axially opposed edges 17 and 19. This first outer edge of such first 17 of the pair of axially opposed outer edges 17 and 19 being located along the predetermined width of such sheet-like roll covering member 11 and at least a substantial portion of such first surface 18 of the axially opposed surfaces 18 and 20 of such first sheet-like portion 12 being located along the first predetermined length of such first flat sheet-like portion 12. Such substantial portion of such first surface 18 of such axially opposed surfaces 18 and 20 of the first flat strip-like portion 12 being at least greater than fifty percent.

A securing means, such as stitching 21 or an adhesive (not shown), is engageable with both the first flat strip-like portion 12 and such sheet-like roll covering member 11 for securing this sheet-like roll covering member 11 to the first surface 18 of the axially opposed surfaces 18 and 20 of such first flat strip-like portion 12

There is a second elongated and substantially flat strip-like portion 22 which has each of axially opposed outer edges 24 and 26 as well as axially opposed surfaces 28 and 30. Such second flat strip-like portion 22 further having a second predetermined length and a second predetermined width, which is less than such first predetermined width of the first flat strip-like portion 12, and a second predetermined thickness. A first surface 28 of such axially opposed surfaces 28 and 30 of such second flat strip-like portion 22 is positioned facing the first surface 18 of such axially opposed surfaces 18 and 20 of the first flat strip-like portion 12. In the presently preferred embodiment of the invention, such first surface 28 of the axially opposed surfaces 28 and 30 of such second flat strip-like portion 22 will be substantially parallel to such first surface 18 of such axially opposed surfaces 18 and 20 of the first flat strip-like portion 12.

Apparatus 10, of the instant invention, further includes a third elongated and substantially flat strip-like portion 32 having each of axially opposed outer edges 34 and 36 and axially opposed surfaces 38 and 40. Such third flat strip-like portion 32 further having a third predetermined length and a third predetermined width, which is also less than such first predetermined width of the first flat strip-like portion 12, and a third predetermined thickness. A first surface 38 of such axially opposed surfaces 38 and 40 of the third flat strip-like portion 32 is positioned such that it faces a second surface 20 of such axially opposed surfaces 18 and 20 of the first flat strip-like portion 12. Likewise, in the presently preferred embodiment of the invention, the first surface 38 of such axially opposed surfaces 38 and 40 of the third flat strip-like portion 32 will be substantially parallel to the second surface 20 of such axially opposed surfaces 18 and 20 of the first flat strip-like portion 12.

Another essential element of the securement apparatus 10 is a first elongated connecting strip-like portion 42 having axially opposed outer edges 44 and 46 and axially opposed surfaces 48 and 50. Such first connecting strip-like portion 42 further having a fourth predetermined length and a fourth predetermined width and a fourth predetermined thickness. A first outer edge 44 of such axially opposed outer edges 44 and 46 of the first connecting strip-like portion 42 being connected to a first outer edge 14 of such axially opposed outer edges 14 and 16 of the first flat strip-like portion 12 along the first predetermined length of such first flat strip-like portion 12 and such fourth predetermined length of such first connecting strip-like portion 42. The second outer edge 46 of such axially opposed outer edges 44 and 46 of the first connecting strip-like portion 42 is connected along the fourth predetermined length thereof to the first outer edge 24 of such axially opposed outer edges 24 and 26 of the second elongated flat strip-like portion 22 along the second predetermined length thereof. The second outer edge 26 of such axially opposed outer edges 24 and 26 of the second flat strip-like portion 22 being engageable in a groove-like portion (not shown) formed adjacent the working surface of such printing plate cylinder. Such groove-like portion extending substantially parallel to a longitudinal axis of such printing plate cylinder.

The final essential element of the apparatus 10 is a second elongated connecting strip-like portion 52 having axially opposed outer edges 54 and 56 and axially opposed surfaces 5 and 60. Such second connecting strip-like portion 52 further having a fifth predetermined length and a fifth predetermined width, which is equal to or less than such fourth predetermined width of such first connecting strip-like portion 42, and a fifth predetermined thickness. The first outer edge 54 of such axially opposed edges 54 and 56 of the second connecting strip-like portion 52 being connected to a second outer edge 16 of the axially opposed outer edges 14 and 16 of such first flat strip-like portion 12 along the first predetermined length of the first flat strip-like portion 12 and the fifth predetermined length of such second connecting strip-like portion 52. A second outer edge 56 of such axially opposed outer edges 54 and 56 of the second connecting strip-like portion 52 is connected along the fifth predetermined length thereof to a first outer edge 34 of the axially opposed outer edges 34 and 36 of such third flat strip-like portion 32 along the third predetermined length thereof, thereby forming a presently preferred embodiment of the specially configured S-shaped printing plate securement apparatus 10 having a sheet-like roll covering member 11 secured thereto.

Figure 3:
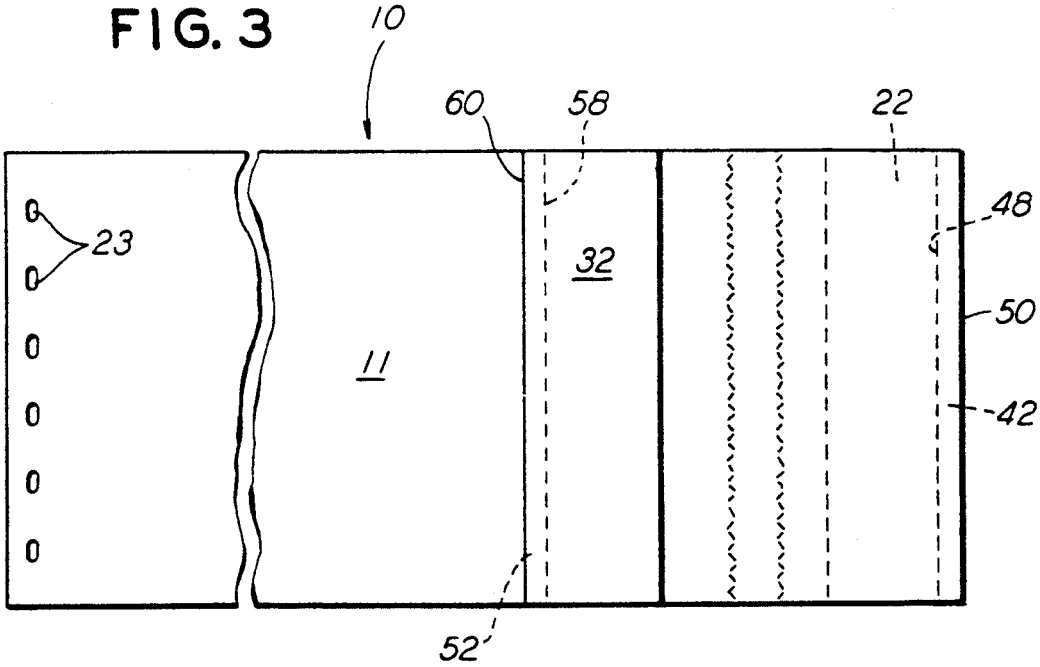
FIG. 3 is a plan view of a presently preferred embodiment of the combination roll covering and specially configured printing plate securement apparatus illustrated in FIG. 1.

According to the presently preferred embodiment of the invention, the predetermined thickness of such sheet-like roll covering member 11 will generally be between about twenty-five thousandths of an inch and about thirty-five thousandths of an inch. The most preferred thickness of such sheet-like roll covering member 11 is generally between about twenty-nine thousandths of an inch and about thirty-one thousandths of an inch. In this embodiment, the predetermined width of such sheet-like roll covering member 11 will be substantially identical to the first predetermined length of such first flat strip-like portion 12 and the predetermined length of such sheet-like roll covering member 11 will generally be less than a length dimension of a circumference of such working surface of the printing plate cylinder. It is presently preferred that such sheet-like roll covering member 11 will be manufactured from one of plastic and a fabric material. However, the most preferred material being a plastic, commonly known in the industry as mylar. As best seen in FIG. 3, such sheet-like roll covering member 11 will preferably include a plurality of apertures 23 formed therethrough. Such apertures 23 are disposed adjacent a second outer edge of such first 17 of the pair of axially opposed outer edges 17 and 19 of the sheet-like roll covering member 11. Each of such plurality of apertures 23 formed through the sheet-like roll covering member 11 is adapted to be engageable by a strap-like member (not shown) used to attach a second axially opposed end of such sheet-like roll covering member 11 to the working surface of the printing plate cylinder. It being understood, however, that means (not shown) other than straps can be used to attach such second axially opposed end of such sheet-like roll covering member 11 to the working surface of the printing plate cylinder.

As seen in FIG. 1, the securing means 21 will preferably be one of stitching or an adhesive-type material with the most preferred securing means being stitching. Also, as best seen in FIG. 1, that narrow portion of the upper surface 13 of such sheet-like roll covering member 11 is engaged with substantially the entire surface area of such first surface 18 of such axially opposed surfaces 18 and 20 of the first flat strip-like portion 12.

In the presently preferred embodiment of the invention, each of such first predetermined length of the first flat strip-like portion 12 and the second predetermined length of such second flat strip-like portion 22 and the third predetermined length of such third flat strip-like portion 32 as well as the fourth predetermined length of such first connecting strip-like portion 42 and such fifth predetermined length of such second connecting strip-like portion 5 will all be substantially identical.

In this embodiment, it is also preferred that the second predetermined width of such second flat strip-like portion 22 and such third predetermined width of the third flat strip-like portion 32 will generally be less than one-half the first predetermined width of such first flat strip-like portion 12.

Likewise, in the preferred embodiment of the invention, the fourth predetermined width of such first connecting strip-like portion 42 will be greater than the fifth predetermined width of such second connecting strip-like portion 52. Furthermore, this fourth predetermined width of such first connecting strip-like portion 42 will be at least sufficient to provide a spacing between such first surface 28 of the axially opposed surfaces 28 and 30 of such second flat strip-like portion 22 and the first surface 18 of the axially opposed surfaces 18 and 20 of the first flat strip-like portion 12 of at least about thirty-thousandths of an inch. In the most preferred embodiment, such fourth predetermined width of the first connecting strip-like portion 42 will provide a spacing between such first surface 28 of the axially opposed surfaces 28 and 30 of such second flat strip-like portion 22 and such first surface 18 of the axially opposed surfaces 18 and 20 of such first flat strip-like portion 12 of between about thirty-thousandths of an inch and about eighty-thousandths of an inch. It should be noted that the spacing between the first surface 38 of the axially opposed surfaces 38 and 40 of the third strip-like portion 32 and such second surface 20 of the axially opposed surfaces 18 and 20 of the first strip-like portion 12 will be less than such spacing between the first surface 28 of the axially opposed surfaces 28 and 30 of such second flat strip-like portion 22 and such first surface 18 of such axially opposed surfaces 18 and 20 of such first flat strip-like portion 12.

Although the present invention is not limited thereto, as will be seen from FIG. 2 which will be discussed hereinafter, it is preferred that such first flat strip-like portion 12 will be formed as a single piece. This is the case because it is preferred that the first strip-like portion 12 and the second strip-like portion 22 and the third strip-like portion 32 as well as the first connecting strip-like portion 42 and the second connecting strip-like portion 52 be formed as an integral single piece unit. The forming of such integral single piece unit is preferably accomplished by an extrusion process. Both plastic and metal extrusion processes are generally well known in the plastic and metal working art. For the sake of economy, the most preferred extrusion process being a plastic extrusion.

In the preferred embodiment of the invention, the spacing formed by surface 28 of the axially opposed surfaces 28 and 30 of such second flat strip-like portion 22 and the surface 18 of the axially opposed surfaces 18 and 20 of such first flat strip-like portion 12 will be substantially uniform across both a width dimension thereof and along a length dimension thereof. It is also presently preferred that the spacing formed by surface 38 of the axially opposed surfaces 38 and 40 of such third flat strip-like portion 32 and the surface 20 of such axially opposed surfaces 18 and 20 of the first flat strip-like portion 12 will also be substantially uniform across a width dimension thereof and along a length dimension thereof.

Such first predetermined thickness of the first flat strip-like portion 12 and such second predetermined thickness of the second flat strip-like portion 22 and the third predetermined thickness of such third flat strip-like portion 32 will be substantially identical in the presently preferred embodiment of the invention.

Further, such fourth predetermined thickness of the first connecting strip-like portion 42 will be substantially identical to such fifth predetermined thickness of the second connecting strip-like portion 52 in this embodiment of the invention.

In the most preferred embodiment of the invention, the predetermined thickness of each of the first flat strip-like portion 12 and the second flat strip-like portion 22 and the third flat strip-like portion 32 and the first connecting strip-like portion 42 and the second connecting strip-like portion 52 will all be substantially identical.

It is also preferred that the predetermined length of each of such first flat strip-like portion 12 and the second flat strip-like portion 22 and the third flat strip-like portion 32 and the first connecting strip-like portion 42 and the second connecting strip-like portion 52 will be at least slightly less than a length of such groove-like portion formed adjacent such working surface of such printing plate cylinder.

Figure 2:
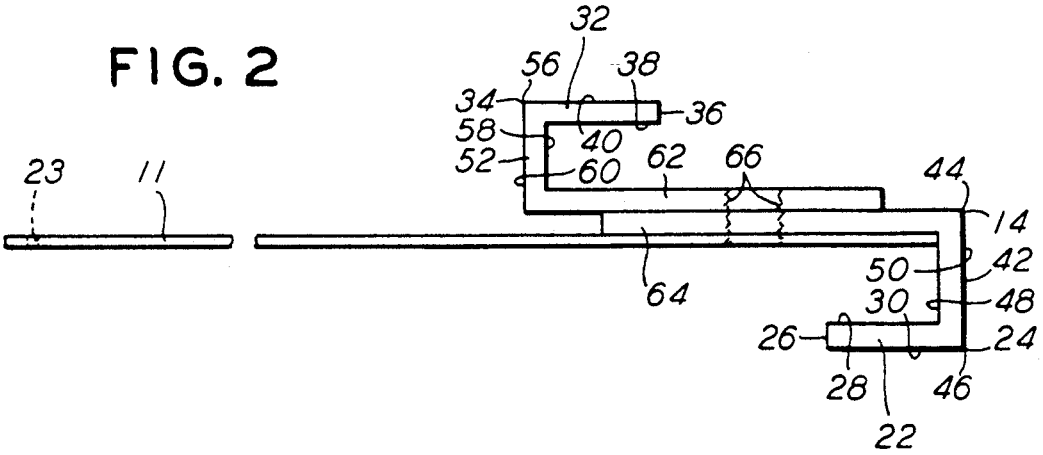
FIG. 2 is as side elevation view of an alternative embodiment of the specially configured securement apparatus illustrated in FIG. 1.

As shown in FIG. 2, the equivalent of the first flat strip-like portion 12 illustrated in FIG. 1 can be formed in two pieces 62 and 64. In this case at least a portion of the elements 62 and 64 must overlap and be secured together in some manner. Such securing of pieces 62 and 64 together may be accomplished by stitching 66 or an adhesive (not shown). In this case, stitching 66 is the preferred means of securing pieces 62 and 64 together to form such first flat strip-like portion 12.

In operation, a bar-like member (not shown) disposed adjacent one edge of the groove-like portion located adjacent the working surface of the printing plate cylinder will be disposed in the spacing formed by surface 28 of the axially opposed surfaces 28 and 30 of such second flat strip-like portion 22, surface 48 of the axially opposed surfaces 48 and 50 of such first connecting strip-like portion and surface 18 of the axially opposed surfaces 18 and 20 of such first strip-like portion. Further, a printing plate (not shown) carried on a sheet-like material (not shown) having a securement apparatus (not shown) attached to a leading edge thereof will be connected to such printing plate cylinder by engagement of such securement apparatus within the spacing formed by surface 38 of such axially opposed surfaces 38 and 40 of such third flat strip-like portion 32, surface 58 of such axially opposed surfaces 58 and 60 of the second connecting strip-like portion 52 and surface 20 of such axially opposed surfaces 18 and 20 of the first flat strip-like portion 12.

Although the combination roll covering and specially configured printing plate securement apparatus 10, of the present invention, is not limited thereto, it is particularly useful in a printing arrangement having a plurality of print stations. Such plurality of print stations being required for printing multi-color prints. In addition, this invention is particularly well suited for use in a flexographic printing arrangement for printing on corrugated board used in packaging for products sold to consumers in retail outlets.

While a number of presently preferred and alternative embodiments of the combination roll covering and specially configured printing plate securement apparatus have been described in considerable detail above, it should be understood that various other modifications and adaptations of the present invention can be envisioned and made by those persons who are skilled in the printing plate securing art without departing from the spirit and scope of the appended claims.

I claim:

1. A combination flexible roll covering member and specially configured printing plate securement apparatus for use both in securing at least one printing plate disposed on an upper surface of a print plate carrier sheet to at least a predetermined portion of a working surface of at least one printing plate cylinder having a groove-like portion and disposed in at least one print station of a printing arrangement and in achieving a relatively rapid alignment of such flexible roll covering member and such printing plate in a predetermined position on such working surface of such printing plate cylinder, said combination flexible roll covering member and specially configured printing plate securement apparatus comprising:

(a) a first elongated and substantially flat strip-like portion having each of axially opposed outer edges and axially opposed surfaces, said first flat strip-like portion further having a first predetermined length and a first predetermined width and a first predetermined thickness;

(b) a generally flexible and substantially rectangular-shape sheet-like member having axially opposed surfaces and a pair of axially opposed outer edges, said sheet-like member having a predetermined length and a predetermined width and a predetermined thickness, a narrow portion of an upper surface of said sheet-like member being engaged with at least a substantial portion of a first surface of said axially opposed surfaces of said first flat strip-like portion adjacent a first outer edge of a first of said pair of axially opposed outer edges of said sheet-like member, said first outer edge of said first of said pair of axially opposed outer edges of said sheet-like member being located along said predetermined width of said sheet-like member and said at least a substantial portion of said first surface of said axially opposed surfaces of said first flat strip-like portion being located along said first predetermined length of said first flat strip-like portion;

(c) a securing means engageable with said first flat strip-like portion and s id sheet-like member for securing said narrow portion of said sheet-like member to said substantial portion of said first surface of said axially opposed surfaces of said first flat strip-like portion;

(d) a second elongated and substantially flat strip-like portion having each of axially opposed outer edges and axially opposed surfaces, said second flat strip-like portion further having a second predetermined length and a second predetermined width, which is less than said first predetermined width of said first flat strip-like portion, and a second predetermined thickness, a first surface of said axially opposed surfaces of said second flat strip-like portion facing a first surface of said axially opposed surfaces of said first flat strip-like portion and a bottom surface of said axially opposed surfaces of said sheet-like member;

(e) a third elongated and substantially flat strip-like portion having each of axially opposed outer edges and axially opposed surfaces, said third flat strip-like portion further having a third predetermined length and a third predetermined width, which is less than said first predetermined width of said first flat strip-like portion, and a third predetermined thickness, a first surface of said axially opposed surfaces of said third flat strip-like portion facing a second surface of said axially opposed surfaces of said first flat strip-like portion;

(f) a first elongated connecting strip-like portion having axially opposed outer edges and axially opposed surfaces, said first connecting strip-like portion further having a fourth predetermined length and a fourth predetermined width and a fourth predetermined thickness; a first outer edge of said axially opposed outer edges of said first connecting strip-like portion being connected to a first outer edge of said axially opposed outer edges of said first flat strip-like portion along said first predetermined length of said first flat strip-like portion and said fourth predetermined length of said first connecting strip-like portion and a second outer edge of said axially opposed outer edges of said first connecting strip-like portion being connected to a first outer edge of said axially opposed outer edges of said second flat strip-like portion along said second predetermined length of said second flat strip-like portion and said fourth predetermined length of said first connecting strip-like portion, a second outer edge of said axially opposed outer edges of said second flat strip-like portion being engageable in such groove-like portion formed adjacent a working surface of such printing plate cylinder and substantially parallel to a longitudinal axis thereof; and (g) a second elongated connecting strip-like portion having axially opposed outer edges and axially opposed surfaces, said second connecting strip-like portion further having a fifth predetermined length and a fifth predetermined width, which is equal to or less than said fourth predetermined width of said first connecting strip-like portion, and a fifth predetermined thickness, a first outer edge of said axially opposed outer edges of said second connecting strip-like portion being connected to a second outer edge of said axially opposed outer edges of said first flat strip-like portion along said first predetermined length of said first flat strip-like portion and said fifth predetermined length of said second connecting strip-like portion and a second outer edge of said axially opposed outer edges of said second connecting strip-like portion being connected along said fifth predetermined length thereof to a first outer edge of said axially opposed outer edges of said third flat strip-like portion along said third predetermined length thereof, thereby forming a specially configured S-shaped printing plate securement apparatus.

2. A combination flexible roll covering and specially configured printing plate securement apparatus, according to claim 1, wherein said predetermined thickness of said sheet-like member is generally between about twenty-five thousandths of an inch and about thirty-five thousandths of an inch.

3. A combination flexible roll covering and specially configured printing plate securement apparatus, according to claim 2, wherein said predetermined thickness of said sheet-like member is generally between about twenty-nine thousandths of an inch and about thirty-one thousandths of an inch.

4. A combination flexible roll covering and specially configured printing plate securement apparatus, according to claim 1, wherein said predetermined width of said sheet-like member is substantially identical to said first predetermined length of said first flat strip-like portion.

5. A combination flexible roll covering and specially configured printing plate securement apparatus, according to claim 4, wherein said predetermined length of said sheet-like member is generally less than a length dimension of a circumference of such working surface of such printing plate cylinder.

6. A combination flexible roll covering and specially configured printing plate securement apparatus, according to claim 5, wherein said sheet-like member is plastic.

7. A combination flexible roll covering and specially configured printing plate securement apparatus, according to claim 6, wherein said plastic is mylar.

8. A combination flexible roll covering and specially configured printing plate securement apparatus, according to claim 5, wherein said sheet-like member includes a plurality of apertures formed therethrough adjacent a second outer edge of said first of said pair of axially opposed outer edges, each of said plurality of apertures formed through said sheet-like member being utilized to attach one end of said sheet-like member to such working surface of such printing plate cylinder.

9. A combination flexible roll covering and specially configured printing plate securement apparatus, according to claim 1, wherein said securing means is at least one of stitching and an adhesive.

10. A combination flexible roll covering and specially configured printing plate securement apparatus, according to claim 9, wherein said securing means is stitching.

11. A combination flexible roll covering and specially configured printing plate securement apparatus, according to claim 1, wherein said narrow portion of said upper surface of said sheet-like member is engaged with substantially an entire surface area of said first surface of said axially opposed surfaces of said first flat strip-like portion.

12. A combination flexible roll covering and specially configured printing plate securement apparatus, according to claim 11, wherein said fourth predetermined width of said first connecting strip-like portion is greater than said fifth predetermined width of said second connecting strip-like portion.

13. A combination flexible roll covering and specially configured printing plate securement apparatus, according to claim 12, wherein said fourth predetermined width of said first connecting strip-like portion is at least sufficient to provide a spacing between said first surface of said axially opposed surfaces of said second flat strip-like portion and a bottom surface of said axially opposed surfaces of said sheet-like member of at least about thirty-thousandths of an inch.

14. A combination flexible roll covering and specially configured printing plate securement apparatus, according to claim 13, wherein said fourth predetermined width of said first connecting strip-like portion provides said spacing between said first surface of said axially opposed surfaces of said sheet-like member generally in a range of between about thirty-thousandths of an inch and about eighty-thousandths of an inch.

15. A combination flexible roll covering and specially configured printing plate securement apparatus, according to claim 14, wherein said spacing between said first surface of said axially opposed surfaces of said second flat strip-like portion and said bottom surface of said axially opposed surfaces of said sheet-like member is substantially uniform across both a width dimension thereof and a length dimension thereof.

16. A combination flexible roll covering and specially configured printing plate securement apparatus, according to claim 1, wherein said first flat strip-like portion and said second flat strip-like portion and said third flat strip-like portion and said first connecting strip-like portion and said second connecting strip-like portion are formed as an integral single piece unit.

17. A combination flexible roll covering and specially configured printing plate securement apparatus, according to claim 16, wherein a spacing between said first surface of said axially opposed surfaces of said third flat strip-like portion and said second surface of said axially opposed surfaces of said first flat strip-like portion is substantially uniform across both a width dimension thereof and a length dimension thereof.

18. A combination flexible roll covering and specially configured printing plate securement apparatus, according to claim 1, wherein said first predetermined thickness of said first flat strip-like portion and said second predetermined thickness of said second flat strip-like portion and said third predetermined thickness of said third flat strip-like portion are substantially identical.

19. A combination flexible roll covering and specially configured printing plate securement apparatus, according to claim 18, wherein said fourth predetermined thickness of said first connecting strip-like portion is substantially identical to said fifth predetermined thickness of said second connecting strip-like portion.

20. A combination flexible roll covering and specially configured printing plate securement apparatus, according to claim 19, wherein said first predetermined length of said first flat strip-like portion and said second predetermined length of said second flat strip-like portion and said third predetermined length of said third flat strip-like portion and said fourth predetermined length of said first connecting strip-like portion and said fifth predetermined length of said second connecting strip-like portion are less than a length of such groove-like portion formed adjacent such working surface of such printing plate cylinder.

* * * * *

UNITED STATES PATENT AND TRADEMARK OFFICE

CERTIFICATE OF CORRECTION

PATENT NO. : 5,086,699

DATED : February 11, 1992

INVENTOR(S) : Ivan N. Philpot

It is certified that error appears in the above-identified patent and that said Letters Patent is hereby corrected as shown below:

Column 2, line 61, delete "elongate", and insert --elongated--.

Column 3, line 22, delete "an", and insert --and--.

Column 6, line 15, after member, insert --11--.

Column 8, line 42, delete "5", and insert --52--.

Column 11, line 19, delete "s id", and insert --said--.

Signed and Sealed this

Twentieth Day of April, 1993

*Attest:*

MICHAEL K. KIRK

*Attesting Officer*

*Acting Commissioner of Patents and Trademarks*